United States Patent [19]

Dickakian

[11] 4,427,530

[45] * Jan. 24, 1984

[54] AROMATIC PITCH DERIVED FROM A MIDDLE FRACTION OF A CAT CRACKER BOTTOM

[75] Inventor: Ghazi Dickakian, Greenville, S.C.

[73] Assignee: Exxon Research and Engineering Co., Florham Park, N.J.

[ * ] Notice: The portion of the term of this patent subsequent to Jun. 2, 1998 has been disclaimed.

[21] Appl. No.: 346,624

[22] Filed: Feb. 8, 1982

[51] Int. Cl.[3] ..... C10C 1/00; C10C 1/20; C10C 3/00

[52] U.S. Cl. ..... 208/22; 208/44; 208/40; 423/447.2; 423/447.4; 423/447.6; 423/449

[58] Field of Search ..... 423/447.4, 447.6, 448, 423/449; 208/22, 44, 40

[56] References Cited

U.S. PATENT DOCUMENTS

| | | | |
|---|---|---|---|
| 2,992,181 | 7/1961 | Renner | 208/22 |
| 3,919,376 | 11/1975 | Schulz | 423/447.4 |
| 3,974,264 | 8/1976 | McHenry | 423/447.6 |
| 4,017,378 | 4/1977 | Fauveau et al. | 423/448 |
| 4,184,942 | 1/1980 | Angier | 423/449 |
| 4,208,267 | 6/1980 | Diefendorf et al. | 208/22 |
| 4,219,404 | 8/1980 | Dickakian | 208/22 |
| 4,271,006 | 6/1981 | Dickakian | 208/41 |

*Primary Examiner*—Delbert E. Gantz
*Assistant Examiner*—Helane Maull

[57] ABSTRACT

A process and a product of the process for preparing a pitch suitable for carbon artifact manufacture features a pitch having a weight content of between 80 and 100 percent toluene insolubles. The pitch is derived from a deasphaltenated middle fraction of a feedstock, such as a cat cracker bottom. The middle fraction is rich in 4, 5 and 6 polycondensed aromatic rings. The pitch is characterized as being relatively free of impurities and ash.

23 Claims, 1 Drawing Figure

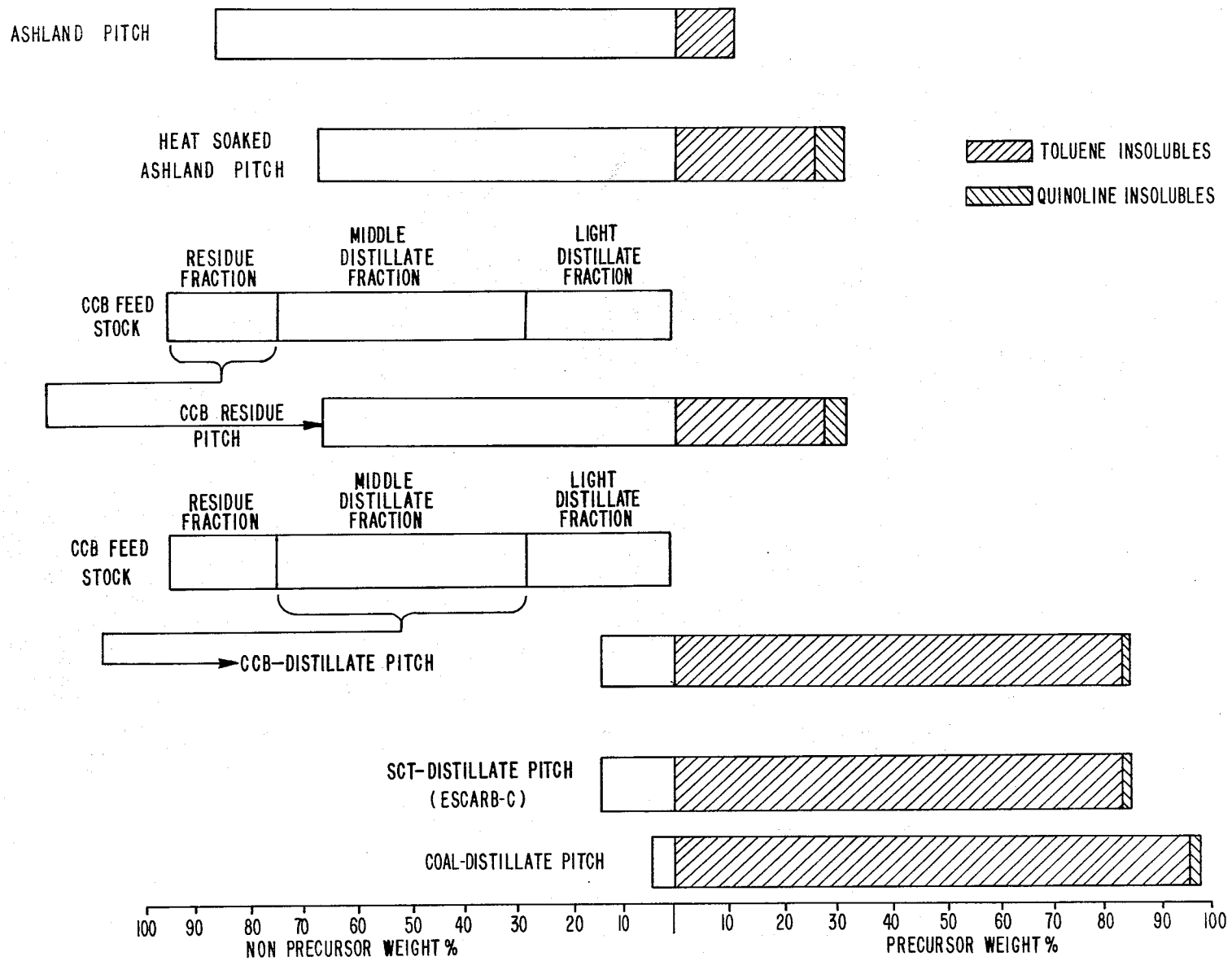
TOLUENE INSOLUBLES
QUINOLINE INSOLUBLES
ASHLAND PITCH
HEAT SOAKED ASHLAND PITCH
CCB FEED STOCK
RESIDUE FRACTION
MIDDLE DISTILLATE FRACTION
LIGHT DISTILLATE FRACTION
CCB RESIDUE PITCH
CCB FEED STOCK
RESIDUE FRACTION
MIDDLE DISTILLATE FRACTION
LIGHT DISTILLATE FRACTION
CCB-DISTILLATE PITCH
SCT-DISTILLATE PITCH (ESCARB-C)
COAL-DISTILLATE PITCH
NON PRECURSOR WEIGHT %
PRECURSOR WEIGHT %
100 90 80 70 60 50 40 30 20 10
10 20 30 40 50 60 70 80 90 100

AROMATIC PITCH DERIVED FROM A MIDDLE FRACTION OF A CAT CRACKER BOTTOM

FIELD OF THE INVENTION

This invention pertains to an aromatic pitch containing a high liquid crystal (optically active) fraction, and more particularly to a pitch which is a suitable feed for manufacturing a carbon artifact.

BACKGROUND OF THE INVENTION

As is well-known, the catalytic conversion of virgin gas oils containing aromatic, naphthenic and paraffinic molecules results in the formation of a variety of distillates that have ever-increasing utility and importance in the petrochemical industry. The economic and utilitarian value, however, of the residual fractions of the cat cracking processes (also known as cat cracker bottoms) has not increased to the same extent as have the light overhead fractions. One potential use for such cat cracker bottoms is in the manufacture of carbon artifacts. As is well known, carbon artifacts have been made by pyrolyzing a wide variety of organic materials. Indeed, one carbon artifact of particularly important commercial interest is carbon fiber. Hence, particular reference is made herein to carbon fiber technology. Nevertheless, it should be appreciated that this invention has applicability to carbon artifacts in a general sense, with emphasis upon the production on shaped carbon articles in the form of filaments, yarns, films, ribbons, sheets, etc.

The use of carbon fibers for reinforcing plastic and metal matrices has gained considerable commercial acceptance. The exceptional properties of these reinforcing composite materials, such as their high strength to weight ratio, clearly offset their high preparation costs. It is generally accepted that large scale use of carbon fibers as reinforcing material would gain even greater acceptance in the marketplace, if the costs of the fibers could be substantially reduced. Thus, the formation of carbon fibers from relatively inexpensive carbonaceous pitches has received considerable attention in recent years.

Many materials containing polycondensed aromatics can be converted at early stages of carbonization to a structurally ordered optically anisotropic spherical liquid crystal called mesophase. The presence of this ordered structure prior to carbonization is considered to be fundamental in obtaining a high quality carbon fiber. Thus, one of the first requirements of a feedstock material suitable for carbon fiber production, is its ability to be converted to a highly optically anisotropic material.

In addition, suitable feedstocks for carbon artifact manufacture, and in particular carbon fiber manufacture, should have relatively low softening points and sufficient viscosity suitable for shaping and spinning into desirable articles and fibers.

Unfortunately, many carbonaceous pitches have relatively high softening points. Indeed, incipient coking frequently occurs in such materials at temperatures where they have sufficient viscosity for spinning. The presence of coke, infusible materials, and/or high softening point components, are detrimental to the fiber-making process. Thus, for example, U.S. Pat. No. 3,919,376 discloses the difficulty in deforming pitches which undergo coking and/or polymerization at the softening temperature of the pitch.

Another important characteristic of the feedstock for carbon artifact manufacture is its rate of conversion to a suitable optically anisotropic material. For example, in the above-mentioned U.S. patent, it is disclosed that 350° C. is the minimum temperature generally required to produce mesophase from a carbonaceous pitch. More importantly, however, is the fact that at least one week of heating is necessary to produce a mesophase content of about 40%, at that minimum temperature. Mesophase, of course, can be generated in shorter times by heating at higher temperatures. However, as indicated above, incipient coking and other undesirable side reactions take place at temperatures in excess of about 425° C.

In U.S. Pat. No. 4,208,267, it has been disclosed that typical graphitized carbonaceous pitches contain a separable fraction which has important physical and chemical properties. Indeed, this separable fraction exhibits a softening range and viscosity suitable for spinning. It also has the ability to be converted rapidly (at temperatures in the range generally of about 230° C. to about 400° C.) to an optically anisotropic, deformable, liquid crystalline material structure. Unfortunately, the amount of separable fraction present in well-known commercially available petroleum pitches, such as Ashland 240 and Ashland 260, to mention a few, is exceedingly low. For example, with Ashland 240, or more than about 10% of the pitch constitutes a separable fraction capable of being thermally converted to a deformable anisotropic phase.

In U.S. Pat. No. 4,184,942, it has been disclosed that the amount of the aforementioned fraction yielding an optical anisotropic pitch can be increased by heat soaking the feedstock at temperatures in the range of 350° C. to 450° C., until spherules visible under polarized light begin to appear.

In U.S. Pat. No. 4,219,404, it has been disclosed that the polycondensed aromatic oils present in isotropic graphitizable pitches are generally detrimental to the rate of formation of highly anisotropic material in such feedstocks when they are heated at elevated temperatures and that, in preparing a feedstock for carbon artifact manufacture, it is particularly advantageous to remove at least a portion of the polycondensed aromatic oils normally present in the pitch simultaneously with, or prior to, heat soaking of the pitch for converting it into a feedstock suitable in carbon artifact manufacture.

More recently, in U.S. Pat. No. 4,271,006 (June 2, 1981), a process has been disclosed for converting cat cracker bottoms to a feedstock suitable in carbon artifact manufacture. Basically, the process requires stripping cat cracker bottoms of fractions boiling below 400° C. and thereafter heat soaking the residue followed by vacuum stripping to provide a carbonaceous pitch.

Cat cracker bottoms like all other heavy aromatic residues obtain from steam cracking, fluid cracking or coal processing are composed of two components: (1) a low molecular weight oil fraction which can be distilled; and (2) an undistillable fraction of high molecular weight. This high molecular weight fraction is insoluble in paraffinic solvents such as n-heptane, iso-octane, pet ether, etc. This fraction is generally called "asphaltene."

It is preferred to use an asphaltene-free feed for the production of pitches. These asphaltenes have a very high molecular weight (up to 10,000), a very high coking characteristic (coking value as high as 67.5 wt% coke yield at 550° C.), and a very high melting point (200°–250° C.).

It is desired to use an asphaltene-free cat cracker bottom. The asphaltene-free cat cracker bottom is free of ash, coke particles and other impurities. The absence of asphaltene, ash, coke particles and other organic and inorganic impurities make the cat cracker bottom distillate an ideal feed for the production of an aromatic pitch with a very high content of liquid crystals. This asphaltene-free cat cracker bottom can be prepared by two methods: (a) by a distillation process; e.g., vacuum or steam distillation; and (b) by deasphaltenation of the cat cracker bottom. The deasphaltenation can be made readily by solvent extraction with a paraffinic solvent.

In application U.S. Ser. No. 291,990 (filed Aug. 11, 1981) and assigned to a common assignee a process is described for heat soaking a deasphaltenated cat cracker bottom.

In application U.S. Ser. No. 225,060 (filed Jan. 14, 1981) and assigned to a common assigneee a process is described for obtaining a feedstock with a low liquid crystal fraction by heat soaking a distillate derived from a cat cracker bottom. The pitch produced in the above application, Ser. No. 225,060 cannot be used directly for carbon fiber production. The liquid crystal fraction has to be extracted from the pitch and used for fiber production.

Whereas, application U.S. Ser. No. 225,060 teaches that all of the cat cracker bottoms can be used to obtain a pitch having low toluene insolubles (Ti), the present invention teaches the opposite, i.e. obtaining a pitch from a fraction of the cat cracker bottoms which has a high Ti content (a high content of liquid crystals).

The present invention uses a deasphaltenated cat cracker bottom fraction rich in 4, 5 and 6 polycondensed aromatic rings, to provide a pitch having a high Ti content and which consequently does not necessarily require Ti solvent extraction prior to spinning into fibers.

The deasphaltenated fraction of the cat cracker bottoms is generally free of ash and impurities. The pitch obtained from this fraction products fibers which have high strength and performance. The deasphaltenated cat cracker bottom fraction obtained in accordance with the present invention, has virtually no coking value at 550° C. compared with a 56% standard coking value for Ashland 240. The deasphaltenated cat cracker bottom fraction as aforementioned is composed of 4, 5, and 6 polycondensed aromatic rings. This provides a uniform feed material which can be carefully controlled to produce a uniform product with a narrow molecular weight distribution.

SUMMARY OF THE INVENTION

The present invention pertains to a high Ti pitch for producing carbon artifacts such as fibers. An aromatic pitch with a very high liquid crystal fraction (80–100%) can be prepared by thermally reacting a deasphaltenated fraction of cat cracker bottoms which is rich in 4, 5 and 6 aromatic rings, at 430° C. for 6–9 hours and then vacuum stripping the reacted mixture to remove at least a portion of the unreacted oils at a temperature in the approximate range of from 320° to 420° C. at 0.1 to 100 mmHg and preferably at greater than 400° C. at 5.0 mmHg of pressure.

More specifically, the cat cracker bottom fraction is heat soaked at approximately 430° C. and vacuum stripped at an approximate temperature of 320°–420° C.

It is an object of this invention to provide an improved pitch for manufacturing a carbon artifact.

It is another object of the invention to provide a pitch for manufacturing carbon fibers which is more uniform, and which is relatively free of ash and impurities.

It is a further object of this invention to provide a pitch having high toluene insolubles, and which does not necessarily require Ti solvent extraction prior to spinning into fibers.

These and other objects of this invention will be better understood and will become more apparent with reference to the following detailed description considered in conjunction with the accompanying drawings.

BRIEF DESCRIPTION OF THE DRAWINGS

A FIGURE shows a graphical representation of various feedstocks including the deasphaltenated cat cracker bottom fraction of this invention, and corresponding Ti content materials derived from heat soaking these feed stocks.

DETAILED DESCRIPTION OF THE INVENTION

The term catalytic cracking refers to a thermal and catalytic conversion of gas oils, particularly virgin gas oils, boiling generally between 316° C. and 566° C., into lighter, more valuable products.

Cat cracker bottoms refer to that fraction of the product of the cat cracking process which boils in the range of from about 200° C. to about 550° C.

Cat cracker bottoms typically have relatively low aromaticity as compared with graphitizable isotropic carbonaceous pitches suitable in carbon artifact manufacture.

Specifications for a typical cat cracker bottom that is suitable in the present invention are given in Table 1:

TABLE 1

| | Range |
|---|---|
| Physical Characteristics | |
| Viscosity cst @ 210° F. | 1.0–10.0 |
| Ash content, wt % | 0.010–02.0 |
| Coking value (wt % @ 550° C.) | 6.0–18.0 |
| Asphaltene (n-heptane insoluble), % | 1.1–12.0 |
| Toluene insolubles (0.35), % | 0.010–1.0 |
| Number average mol. wt. | 220–290 |
| Elemental Analysis | |
| Carbon, % | 88.0–90.32 |
| Hydrogen, % | 7.74–7.40 |
| Oxygen, % | 0.10–0.30 |
| Sulfur, % | 1.0–4.5 |
| Chemical Analysis (proton NMR) | |
| Aromatic carbon (atom %) | 54–72 |
| Carbon/hydrogen atomic ratio | 0.90–1.0 |
| Asphaltene Analysis | |
| Number average mol. wt. | 550–750 |
| Coking value, wt % at 550° C. | 3.5–6.5 |
| Aromatic carbon (atom %) | 55–70 |
| Bureau of Mines Correlation Index | 120–140 |

In the process of the present invention, the cat cracker bottoms are fractionally distilled by heating the cat cracker bottom to elevated temperatures and reduced pressures, for example, by heating to temperatures in the range of 200° C. to 300° C. at pressures ranging from about 250 to 500 microns of mercury. Basically, the cat cracker bottom is separated into at least a single distillate having a boiling point at 760 mm mercury in the range of from about 250° C. to about 530° C., and the residue being the fraction not distillable at temperatures up to 530° C., at a pressure of about 350 to 450 microns of mercury. In a particularly preferred embodiment of the present invention, the distillate fraction of the cat cracking bottom which is employed in forming a suitable carbonaceous pitch for carbon artifact manufacture is that fraction boiling in the approximate range of about 450° C. to about 510° C. at 760 mm of mercury. The desired cat cracker bottom fraction can also be obtained by other commercially known separation methods such as steam distillation, flash stripping or by using a thin film evaporator.

To produce a pitch with a high fraction of anisotropic liquid crystal, the cat cracker bottom fraction is heat soaked at temperatures in the approximate range of 350° C. to 500° C. Optionally and preferably, the heat soaking is conducted at temperatures in the approximate range of about 390° C. to about 450° C., and most preferably at temperatures in the approximate range of about 410° C. to about 440° C. In general, heat soaking is conducted for times ranging from one minute to about twenty hours, and preferably from about six to nine hours. In the practice of the present invention, it is particularly preferred that heat soaking be done in an atmosphere such as nitrogen, or alternatively in a hydrogen atmosphere. Optionally, however, heat soaking may be conducted at high pressure or reduced pressures, for example, pressures in the range of from about 50 to 100 mm of mercury.

When the heat soaking is completed, the reaction mixture is then subjected to a reduced pressure at a liquid temperature between 320°–420° C., and most preferably at 400°–420° C., to remove from the mixture at least part of the distillable unreacted oils. Preferably, all of the unreacted oils are removed in order to concentrate and increase the anisotropic liquid crystal fraction in the final pitch product. The use of a high liquid temperature, e.g., 400°–420° C., is very desirable. The high liquid temperature helps to remove the distillable unreacted oils, which if left in the final pitch product tend to dilute and reduce the liquid crystal content of the pitch. Optionally, the heat soaked mixture can be purged with a gas such as nitrogen in order to accelerate the removal of the unreacted oils.

The resultant pitch produced by the above-described method has a low melting point (190°–250° C.), has very high aromaticity (85–90% of aromatic carbon atoms by carbon NMR method) and contains a high anisotropic liquid crystal fraction (80–100% by polarized light microscopy). The pitch composition is defined readily by using solvent analysis, wherein the content insolubles in toluene at room temperature and the content insolubles in quinoline at 75° C. are determined. The toluene insoluble (Ti) fraction in the pitch can be used to give a measure of the liquid crystal content in the pitch. One of the objectives of this invention is to transform the cat cracker bottom distillate fraction into a pitch with a very high content of toluene insolubles (80–100%), but with a low content of quinoline insolubles (0.1–15%).

Where the toluene insoluble fraction in the pitch is very high, i.e. approaching 100%, solvent extracting the Ti insolubles is unnecessary, and the resultant pitch can be directly spun into carbon fibers.

A more complete understanding of the process of this invention can be obtained with reference to the following examples, which are illustrative only and are not meant to limit the scope of the invention defined by the appended claims.

EXAMPLES 1–4

In each of the following examples (Examples 1–4; Table 4), 12 kilograms of a cat cracker bottom having the following physical inspections were used:

| | |
|---|---|
| Physical Characteristics | |
| Viscosity cst @ 210° F. | 9.0 |
| Ash content, wt % | 0.015 |
| Coking value (wt % at 550° C.) | 6.9 |
| Asphaltene (n-heptane insoluble), % | 1.0 |
| Toluene insolubles (0.35μ), % | 0.150 |
| Number average mol. wt. | 280 |
| Elemental Analysis | |
| Carbon, % | 89.29 |
| Hydrogen, % | 7.92 |
| Oxygen, % | 0.15 |
| Sulfur, % | 2.90 |
| Chemical Analysis (proton NMR) | |
| Aromatic carbon (atom %) | 56 |
| Carbon/hydrogen atomic ratio | 0.94 |
| Asphaltene Analysis | |
| Number average mol. wt. | 660 |
| Coking value, wt % at 550° C. | 5.0 |
| Bureau of Mines Correlation Index | 125 |

The cat cracker bottom was charged into a 20 kilogram stainless steel reactor which was electrically heated and equipped with a mechanical agitator. A vacuum was applied during the heating and the cat cracker bottom was distilled into seven fractions tabulated below in Table 2:

TABLE 2

| Fractions | Boiling Point, °C./760 mm Mercury | Wt % |
|---|---|---|
| Distillate Fraction 1 | 271–400 | 10.0 |
| Distillate Fraction 2 | 400–427 | 23.8 |
| Distillate Fraction 3 | 427–454 | 13.3 |
| Distillate Fraction 4 | 454–471 | 11.7 |
| Distillate Fraction 5 | 471–488 | 13.4 |
| Distillate Fraction 6 | 488–510 | 10.0 |
| (Residue) | 510+ | 17.5 |

The boiling point corrected to atmospheric pressure and weight percent breakdown of fractions 3–6 is given in Table 3 below:

TABLE 3

Chemical and Physical Characteristics of Distillate Fractions 3–6 (426–510° C.) of Cat Cracker Bottoms

| | |
|---|---|
| Ash (wt %) | 0.0001 |
| Asphaltene (n-heptane insolubles), % | nil |
| Coking value (coke yield at 550° C.) | nil |
| Average mol wt % (MS-method) | 260 |
| Carbon/hydrogen atomic ratio | 0.89 |
| Aromaticity (aromatic carbon atom % by NMR) | 66 |
| Aromatic Ring Distribution (MS-method) | |
| 1 ring (%) | 1.5 |
| 2 ring (%) | 13.0 |
| 3 ring (%) | 31.0 |
| 4 ring (%) | 44.0 |
| 5 ring (%) | 6.4 |
| 6+ ring (%) | 1.0 |
| Aromatic Ring Composition (by MS-method) | |
| Rings with carbon and hydrogen (%) | 63 |
| Rings with carbon, hydrogen and oxygen (%) | 2 |
| Rings with carbon, hydrogen and sulfur (%) | 33 |

Mass Spectrometric Analysis of the Distillate Fractions 3–6 (427–510° C.) of Cat Cracker Residue Indicated the Presence of the Following Main Polycondensed Aromatics Weight (%)

TABLE 3-continued

| Molecular Formula | Typical Name | (Average Molecular Weight) |
|---|---|---|
| $C_nH_{2n-16}$ | Acenophthenes | 1.54 (218) |
| $C_nH_{2n-18}$ | Phenanthrenes | 8.95 (243) |
| $C_nH_{2n-20}$ | Naphtheno-Phenanthrene | 9.78 (254) |
| $C_nH_{2n-22}$ | Pyrenes | 15.4 (253) |
| $C_nH_{2n-24}$ | Chrysenes | 8.70 (265) |
| $C_nH_{2n-26}$ | Cholanthrenes | 2.9 (283) |
| $C_nH_{2n-14}S$ | Benzopyrene | 1.0 (295) |
| $C_nH_{2n-16}S$ | Indothiophenes | 1.45 (280) |
| $C_nH_{2n-18}S$ | Naphthotiophene | 4.7 (249) |
| $C_nH_{2n-20}S$ | Acenophthylene Thiophenes | 4.0 (273) |
| $C_nH_{2n-22}S$ | Anthraceno-Thiophenes | 3.8 (261) |
| $C_nH_{2n-24}S$ | Naphteno-Phenanthreno Thiophenes | 9.9 (271) |
| $C_nH_{2n-26}S$ | Pyrenothiophenes | 1.20 (295) |
| $C_nH_{2n-28}S$ | Chryseno-Thiophenes | 0.82 (295) |
| $C_nH_{2n-30}S$ | | |

finally the solid was dried at 120° C. in the vacuum for 24 hours.

The toluene insolubles in the pitch was determined by a one stage extraction method. The one stage method is defined as the process of simply agitating the pitch and toluene (pitch: toluene ratio 1:8) at room temperature for 4.0 hours and then filtering, washing and drying it.

The optical anisotropicity of the pitch was determined by first heating the pitch to 375° C. and then after cooling it and placing a sample of the pitch on a slide with Permount, a histological mounting medium sold by the Fisher Scientific Company, Fairlawn, N.J. A slip cover was placed over the slide by rotating the cover under hand pressure, the mounted sample was crushed to a powder and evenly dispersed on the slide. Thereafter the crushed sample was viewed under polarized light at a magnification factor of 200× and the percent optical anisotropicity was estimated.

Table 4 below, illustrates the Ti and Qi characteristics of the pitch of this invention (Examples 1–4):

TABLE 4

| | Production of Pitch with High Liquid Crystal from Distillate of Cat Cracking Residue | | | | | | | | | | | |
|---|---|---|---|---|---|---|---|---|---|---|---|---|
| | Heat Soaking Stage | | Vacuum Stripped Stage | | | Pitch Composition | | | Characteristics of Toluene Insolubles (SEP) | | | |
| | | | | Liquid | | | | | | | | |
| Example | Temperature (°C.) | Time (hrs) | Pressure (mmHg) | Temperature (°C.) | Oil (%) Removed | % Toluene Insolubles (SEP) | % Toluene Insolubles (One-Stage) | % Quinoline Insolubles | Tg | C/H | Optical Anisotropy (%) | Vicosity cps @ 360° C. |
| 1 | 430 | 6.5 | 0.25 | 420 | 29.0 | 91.3 | 95.9 | 9.2 | 231 | 1.80 | 100 | — |
| 2 | 430 | 6.5 | 0.70 | 360 | 22.0 | 84.7 | — | 9.0 | 226 | 1.81 | — | 410 |
| 3 | 430 | 6.0 | 0.25 | 370 | 30.7 | 82.8 | 88.0 | 0.5 | 236 | 1.80 | — | — |
| 4 | 430 | 6.0 | 0.25 | 420 | 42.6 | 86.6 | 94.7 | 0.5 | 235 | — | — | — |

The following method was used to produce pitches described in this patent application:

Seventy pounds of distillate Fractions 3–6 (427°–510° F.) were charged to a 10 gallon reactor heated electrically. The reactor was equipped with good mechanical agitation, nitrogen injection and blanketing, and a distillate recovery system (condenser and receiver). The distillate fractions 3–6 were heated slowly (4–8 hours) to 430° C. ±1.0° C. under a blanket of nitrogen. The mixture was then heat soaked for the desired time with good agitation and continuous nitrogen blanketing.

The heat soaked mixture was then vacuum stripped at reduced pressure 0.2–1.0 mmHg at a liquid temperature 400°–420° C. to remove all distillable oils. The vacuum stripped pitch was allowed to cool under reduced pressure and discharged.

The percent quinoline insolubles in the product pitch was determined by the standard technique of quinoline extraction at 75° C. (ASTM Test Method No. D2318/76).

The toluene insoluble fraction of the pitch was determined by the following SEP (Standard Extraction Procedure) method:

40 grams of crushed sample were mixed for 18 hours at room temperature with 320 ml of toluene. The mixture was thereafter filtered using a 10–15 micron fritted glass filter.

The filter cake was washed with 80 ml of toluene, reslurried and mixed for four hours at room temperature with 120 ml of toluene, filtered using a 10–15 micron glass filter.

The filter cake was washed with 80 ml of toluene followed by a wash with 80 ml of heptane, and Referring to the illustrative FIGURE, various feedstocks are shown including the deasphaltenated cat cracker bottom fraction of this invention. These feedstocks are shown divided into their corresponding percentages of useable (precursor) pitch materials, and non-useable (non-precursor) pitch materials. It is observed that when all the cat cracker bottom fractions are used to obtain precursor materials, only a small percentage of liquid crystal rich materials are obtained. For example, heat soaked Ashland Pitch is observed to contain only approximately 25 percent Ti precursor.

Such a pitch material must be further treated to extract the useable Ti fraction. However, the problem with extracting the Ti content from such a pitch material is that it is very difficult to do this without also including the so-called "bad actors." In other words, the impurities and ash are also carried along. In addition, heat treating these low Ti materials will very often produce coke, which is detrimental to the spinning process.

Therefore, the elimination of the "bad actors" and the coke producing substances in advance of further processing would not only be desirable in producing a trouble-free precursor material, but also should usually eliminate the need to perform an additional extraction step.

Thus, it is observed that a feedstock material which uses only a middle fraction, i.e. distillate fractions 3–6 (427°–510° C.), of a cat cracker bottom, will be virtually free of the "bad actors," and will contain between 80 and 100% Ti after heat soaking and vacuum stripping. Such precursor materials will be very uniform, relatively free of ash and impurities as further defined by a low quinoline insoluble content (less than 15% by weight), and will easily lend themselves to further controlled processing.

As aforementioned, such precursors may not require an additional extraction step for the Ti.

The FIGURE also represents similar results obtained from other feedstock materials such as Steam Cracker Tars (SCT) and Coal. When the middle fractions of these feedstocks are separated, heat soaked, and vacuum stripped, it is observed that high content Ti substances are also produced.

Thus, the invention is not necessarily limited to the starting materials, but rather to the realization of the need to prefractionate and separate the middle fractions from these materials, and to vacuum strip these fractions after heat soaking at temperatures generally in excess of 400° C.

A pitch of this invention can be generally defined by the following solvent analysis:

| Solvent Analysis | |
|---|---|
| Toluene insolubles wt % (SEP method) | 80–100 |
| Quinoline insolubles wt % (ASTM D2318-66) | 1.0–15 (preferably less than 5%) |
| Aromaticity (% Aromatic carbon atom) | 80–90 |
| Melting point (°C.) | 150–250 |
| Galss Transition Temperature (°C.) (Tg) | 170–220 |
| Ash wt % | nil–0.1 |
| Optical Activity (% by polarized light microscopy) | 70–100 |

Having thus described this invention, what is desired to be protected by Letters Patent is presented in the following appended claims.

What is claimed is:

1. A pitch suitable for carbon artifact manufacture, comprising by weight content between 80 and 100 percent toluene insolubles, said pitch having been derived, by heat soaking followed by vacuum stripping, from a deasphaltenated middle fraction of a cat cracker bottom feedstock which is rich in 4, 5 and 6 polycondensed aromatic rings, and wherein said pitch is further characterized as being relatively free of impurities and ash.

2. The pitch of claim 1, wherein said middle fraction is a distillate fraction boiling off at temperatures approximately between 427° and 510° C. at 760 mm mercury.

3. A pitch suitable for carbon artifact manufacture, such as the manufacture of carbon fibers, comprising by weight content between 80 and 100 percent toluene insolubles, and derived, by heat soaking followed by vacuum stripping, from a deasphaltenated middle distillate fraction of a cat cracker bottom boiling off at temperatures approximately between 427° and 510° C. at 760 mm mercury, said pitch being further characterized as being relatively free of impurities and ash.

4. The pitch of claim 3, wherein said middle fraction is rich in 4, 5, and 6 polycondensed aromatic rings.

5. A pitch suitable for carbon artifact manufacture, comprising by weight content between 80 and 100 percent toluene insolubles, said pitch having been derived, by heat soaking followed by vacuum stripping, from a deasphaltenated middle fraction of a cat cracker bottom feedstock which is rich in 4, 5 and 6 polycondensed aromatic rings, and wherein said pitch is further characterized as having approximately less than 15 percent quinolline insolubles by weight.

6. The pitch of claim 5, wherein said middle fraction is a distillate fraction boiling off at temperatures approximately between 427° and 510° C. at 760 mm mercury.

7. The pitch of claim 5, wherein said quinoline insolubles are less than 5 percent by weight.

8. A process for preparing a pitch suitable for carbon artifact manufacture, comprising the steps of:

(a) obtaining a deasphaltenated middle fraction of a cat cracker bottom feedstock which is rich in 4, 5, and 6 polycondensed aromatic rings;

(b) subjecting said middle fraction to heat soaking to produce a pitch intermediate; and (c) removing a light portion comprising oils from said pitch intermediate to produce a pitch comprising between 80 and 100 percent by weight of toluene insolubles, and which is further characterized as having approximately less than 15 percent quinoline insolubles by weight.

9. The process of claim 8, wherein said thermal reaction includes heat soaking said middle fraction at a temperature in an approximate range of between 390° and 450° C. for a duration of from 1 minute to 20 hours at 760 mm of mercury.

10. The process of claim 9, wherein said middle fraction is heat soaked at approximately 430° C. for 7 to 9 hours at 760 mm of mercury.

11. The process of claim 8, wherein said middle fraction is obtained by distilling said feedstock at a temperature in an approximate range of between 427° and 510° C. at 760 mm of mercury.

12. The process of claim 8, wherein said portion of said pitch intermediate comprises oils, and further wherein said oils are removed by vacuum stripping said intermediate at a temperature in an approximate range of between 320° to 420° C. at approximately 0.1 to 100 mm of mercury.

13. A process for preparing a pitch suitable for carbon artifact manufacture comprising the steps of:

(a) distilling a cat cracker bottom feedstock to obtain a deasphaltenated middle fraction rich in 4, 5 and 6 polycondensed aromatic rings;

(b) heat soaking said middle fraction; and (c) vacuum stripping said heat soaked middle fraction to remove oils therefrom, resulting in a pitch comprising 80 to 100 percent by weight of toluene insolubles and further characterized as having approximately less than 15 percent quinoline insolubles by weight.

14. The process of claim 13, wherein said heat soaking step (b) includes heat soaking said middle fraction at a temperature in an approximate range of between 390° and 450° C. for a duration of from 1 minute to 20 hours at 760 mm of mercury.

15. The process of claim 14, wherein said middle fraction is heat soaked at approximately 430° C. for 7 to 9 hours at 760 mm of mercury.

16. The process of claim 13, wherein said distilling step (a) includes distilling said feedstock at a temperature in an approximate range of 427° to 510° C. at 760 mm of mercury.

17. The process of claim 13, wherein said vacuum stripping step (c) includes vacuum stripping said heat soaked middle fraction at a temperature in an approximate range of between 320° and 420° C. at approximately 0.1 to 100 mm of mercury.

18. A process for preparing a pitch suitable for carbon artifact manufacture, comprising the steps of:

(a) distilling a cat cracker bottom to obtain a deasphaltenated middle fraction rich in 4, 5 and 6 polycondensed aromatic rings;

(b) heat soaking said middle fraction; and (c) vacuum stripping said heat soaked middle fraction to remove oils therefrom, resulting in a pitch comprising 80 to 100 percent by weight of toluene insolubles and further characterized as being relatively free of impurities and ash.

19. A pitch suitable for carbon artifact manufacture made by the process including the steps of:

(a) distilling a cat cracker bottom to obtain a deasphaltenated middle fraction rich in 4, 5 and 6 polycondensed aromatic rings;

(b) heat soaking said middle fraction; and (c) vacuum stripping said heat soaked middle fraction to remove oils therefrom, resulting in a pitch comprising 80 to 100 percent by weight of toluene insolubles and further characterized as being relatively free of impurities and ash.

20. A process for preparing a pitch suitable for carbon artifact manufacture, comprising the steps of:

(a) distilling a cat cracker bottom to obtain a deasphaltenated middle fraction rich in 4, 5 and 6 polycondensed aromatic rings;

(b) heat soaking said middle fractions; and (c) vacuum stripping said heat soaked middle fraction to remove oils therefrom at a temperature approximately above 400° C. at from approximately 1 to 100 mm of mercury, resulting in a pitch comprising 80 to 100 percent by weight of toluene insolubles and further characterized as being relatively free of impurities and ash.

21. The process of claim 20, wherein said vacuum stripping step (c) is conducted at a temperature approximately from 400° to 425° C.

22. A pitch suitable for carbon artifact manufacture made by the process including the steps of:

(a) distilling a cat cracker bottom to obtain a deasphaltenated middle fraction rich in 4, 5 and 6 polycondensed aromatic rings;

(b) heat soaking said middle fraction; and (c) vacuum stripping said heat soaked middle fraction to remove oils therefrom at a temperature approximately above 400° C. at from approximately 1 to 100 mm of mercury, resulting in a pitch comprising 80 to 100 percent by weight of toluene insolubles and further characterized as being relatively free of impurities and ash.

23. The pitch of claim 22, wherein said vacuum stripping step (c) is conducted at a temperature approximately from 400° to 425° C.

* * * * *